United States Patent [19]

Summers et al.

[11] 3,985,171

[45] Oct. 12, 1976

[54] CLUB PROTECTING COVER FOR GOLF BAG

[75] Inventors: James B. Summers, Lima, Ohio; Robert E. Bourke, Westport, Conn.

[73] Assignee: NBS, Inc., Huntsville, Ohio

[22] Filed: Sept. 2, 1975

[21] Appl. No.: 609,503

[52] U.S. Cl. ..... 150/52 G; 150/1.5 R

[51] Int. Cl.[2] ..... A63B 55/00

[58] Field of Search ..... 150/1.5 R, 1.5 B, 1.5 C, 150/52 G

[56] References Cited

UNITED STATES PATENTS

| | | | |
|---|---|---|---|
| 1,957,577 | 5/1934 | Chapman | 150/52 G UX |
| 2,704,563 | 3/1955 | Henrich | 150/1.5 R |
| 2,925,840 | 2/1960 | Hird | 150/52 G X |
| 3,521,689 | 7/1970 | Woods | 150/52 G X |
| 3,913,648 | 10/1975 | Sessler | 150/52 G X |

*Primary Examiner*—Donald F. Norton
*Attorney, Agent, or Firm*—Mahoney & Stebens

[57] ABSTRACT

A protective cover is provided for a golf bag with this cover including a dual compartment interior construction. The cover comprises a shell-form body fabricated from a pliable sheet material and dimensionally configured to cooperatively interfit the open, tip-end of a golf bag. Constructed in the interior of the shell-form body which is of elongated tubular shape having a closed end, is a longitudinally extending partition wall which divides the interior into two compartments for receiving the irons and the woods, respectively. A resilient securing cord is provided which extends around the shell-form body and has attachment hooks secured to each end for engaging belt loops or attachment rings fastened to the upper peripheral edge or end of the golf bag. The resilient cord extends across the body in a transverse manner at the juncture of the partition wall to cooperate therewith in maintaining the irons and woods in segregated pockets, particularly if the golf bag should be inadvertently inverted.

9 Claims, 4 Drawing Figures

CLUB PROTECTING COVER FOR GOLF BAG

BACKGROUND OF THE INVENTION

Various types of protective covers have heretofor have been devised for enclosing and providing protection for the upstanding clubs in a golf bag. These covers have in the main been of two distinct types. The first type is the relatively conventional construction incorporating a single compartment shell that is positioned over the ends of the clubs protruding from the golf bag and secured to the top of the golf bag. This type of cover is merely a rain or dust protector and has only a single interior compartment.

The second major type of prior art cover is best defined as an individual club protector that is most often provided only for the woods. These covers may have one or more compartments which receive respective club heads with the cover usually being secured and supported entirely by the clubs. This second type of cover, which is generally fabricated from a pliable material such as vinyl or knitted fabric, does provide protection as between individual clubs to avoid nicking and maring occurring as a result of justling during carrying or transport of the bag or when picking up or laying down the golf bag. While some portection is provided by this type of cover to prevent this maring and scratching of club heads, such a cover does not provide any substantial structural protection or segregation as between the relatively heavy irons and the woods.

The problem to which this invention is directed is encountered most often during transport of a golf bag on commercial aircraft. A golf bag is generally and usually required to be carried in the cargo compartment of an aircraft and is thus subject to numerous intermediate handling and transfer operations between the terminal and aircraft and return upon completion of the trip. Loading and unloading operations at the aircraaft usually involve the use of inclined, mechanized conveyors and golf bag in the course of usual handling is merely placed on the conveyor. If a golf bag is improperly positioned on the conveyor, such as having the upper end projecting or extending over the edge of the conveyor, there is a very strong possibility that the entire golf bag will fall off the conveyor and onto the pavement below. When this happens, the golf bag will initially hit in an inverted position with the golf heads extending downwardly. The prior art covers are inadequate and not designed to restrain the downward movement of the clubs, and as a consequence, the relatively heavy irons which are of a shorter length than the woods will gather momentum and forceably drive into the heads of the woods where they can severly mar, crack the head or even readily break the head from the shaft.

This problem has been increasing due to the substantial increase in air travel with people carrying their own clubs for personal use at the destination. Also, while air travel has been used as an example, careless handling by personnel of hotels, resorts and golf courses while transporting golf bags as luggage can obviously result in simimlar damage. Accordingly, a real need has been developed to provide a protective cover which will effectively prevent this type of injury or damage to the woods of a club set to the mutual benefit of the golfer and the transportation agency since it is expensive and time consuming and nearly impossible, to replace one club of a matched set of woods.

SUMMARY OF THE INVENTION

In accordance with this invention, a protective cover for a golf bag is provided having a compartmented construction with sufficient structural strength to prevent the irons from hitting the woods and damaging the woods in the afore stated situation. This cover comprises a shell-form body fabricated from a pliable sheet material and is of a tubular configuration. One end of the sheel is closed with the other end open and positionable in cooperative closing engagement with the open top end of a golf bag. The interior of the shell-form body is divided into two compartments by a partition wall which is also formed from a pliable material. This partition wall extends transversely across the tubular body as well as extending longitudinally from the open end of the body. The interior end of the partition wall is secured to the wall of the shell-form body in remotely spaced relationship to the open end, thus dividing the body into two longitudinally extending compartments with the one compartment being of relatively shorter length to more closely interfit with the shorter length of the irons. Protection additional to the compartmentilization provided by the partitioning wall is obtained through lining the interior of the shell-form body with a layer of foamed plastic or other resiliently compressible material. This not only provides cushioning for the clubs, but also means to absorb some of the momentum force developed by the clubs when the bag is inverted and dropped.

Maintenance of the two separated compartments is a primary consideration in the successful operation of the protective golf bag cover of this invention. Fabrication of a protective cover from a pliable material will obviously not result in structure which will inherently maintain the desired separation as between the two compartments. While the pliable material is selected on a basis of having the necessary structural strength to withstand the substantial momentum forces often encountered in this situation, the material being pliable, is not capable of preventing the one compartment from collapsing into the other with the consequent undesired result of the irons forcibly bearing on the woods. Achievement of the desired objective of maintaining the compartments in completely separated or isolated relationship is accomplished by means of a resilient cord. This resilient cord is of a length to extend downwardly along the sides of the cover to the upper end of a golf bag on which the cover is positioned. Each end of the resilient cord is provided with hook elements to facilitate engagement with retaining rings or loops that may be integrally formed or are otherwise attached to the golf bag. In accordance with this invention, the resilient cord extends transversely across the cover at the juncture point of the partition wall with the shell-form body. A retainer loop or sleeve is secured to the outer surface of the shell-form body at that point and the resilient cord extends therethrough.

With the protective cover of this invention installed on a golf bag, inversion of the golf bag will result in the irons being maintained in a separate compartment from that into which the woods project by means of the resilient cord. Deformation of the shell-form body as well as the partition will due to the combined action of the weight and force of the clubs tending to collapse the one compartment into the other will be prevented through the operation of the resilient cord which applies a separating force between the two compartments. The resilient cord also reduces the downward momentum of the heavy destructive weight of the irons, usually ten in number. Additionally, the resilient cord provides some cushioning effect in addition to any interior cushioning or padding material in the shell-form body.

These and other objects and advantages of this invention will be readily apparent from the following detailed description of an embodiment thereof, and the accompanying drawing illustrating a protective golf bag cover of this invention.

DESCRIPTION OF THE DRAWING FIGURES

DETAILED DESCRIPTION OF THE ILLUSTRATED EMBODIMENT

Figure 1:
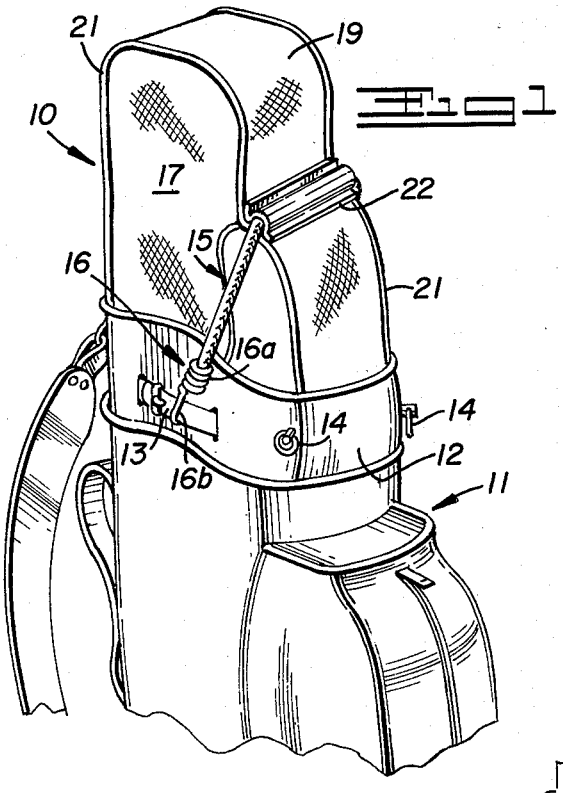
FIG. 1 is a prospective view of the club protecting cover of this invention installed on the upper end of a golf bag, which is only fragmentarily shown.

Having reference to FIG. 1 specifically of the drawings, a club protecting cover generally designated by the numeral 10 is shown positioned in cooperative relationship with a golf bag 11. This golf bag which is merely illustrative of the general construction comprises an upper marginal end portion 12 defining an open top. A reinforcing band or collar is usually incorporated in the upper marginal end portion to provide rigidity and structural strength. Also, as is the customary practice, various types of attachment belts or loops 13 and connector rings 14 are secured to or mounted on this upper end portion and reinforcing band 12 for interconnection with various types of accessories. Attachment or securing of the club protecting cover 10 to the golf bag 11 is accomplished in accordance with this invention by means of a resilient cord 15 which extends around the exterior of the cover 10. Each of the two ends of the resilient cord 15 are provided with connector hooks, 16 adapted to securely engage with attachment means on the golf bag, which in the illustrated instance are the attachment belts, 13 exposed at each side of the golf bag. It will also be noted in FIG. 1 that the club protecting cover end is dimensioned to interfit within the open top of the golf bag 11 with the lower edge being supported on internal structural elements of the golf bag. A golf bag may not be of circular construction and may more closely approximate a rectangular or oval shape. Whether circular or rectangular, a cover would be configured to closely interfit about the interior surfaces of the upper marginal end portion 12.

Figure 2:
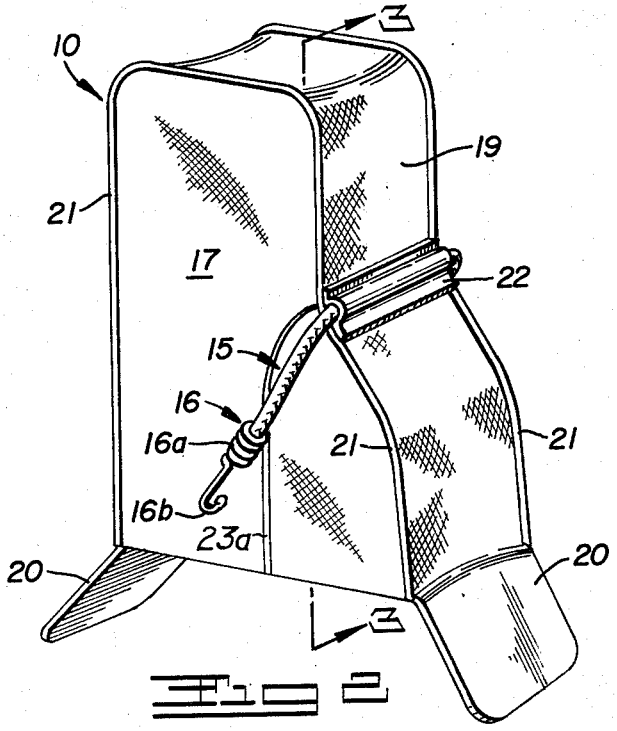
FIG. 2 is a prospective view of the club protecting cover on an enlarged scale.
Figure 3:
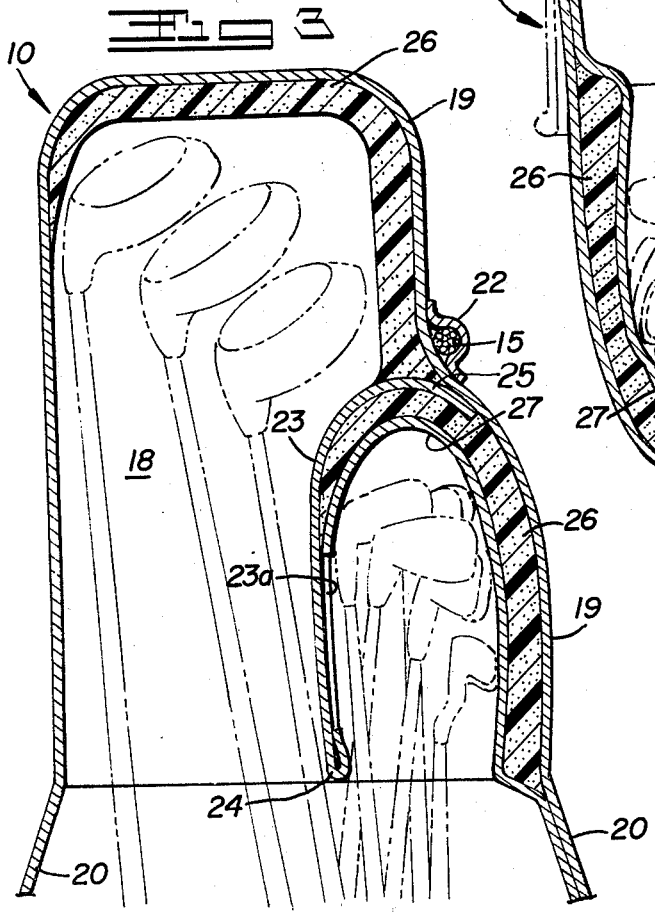
FIG. 3 is a sectional view on a further enlarged scale taken along a plane passing through line 33 of FIG. 2.

Specifics of construction of the illustrated embodiment can be best seen in FIGS. 2 and 3. FIG. 2, which is a prospective view of a cover separate from the golf bag, illustrates the shell-form configuration of the cover. The shell-form body is fabricated from a pliable sheet material such as the now readily available synthetic materials having desired characteristics of strength and durability. Forming the shell-form body are front and back panels, 17 and 18, interconnected in spaced relationship ship by a peripherally extending side wall 19. This side wall 19 extends around three sides of the periphery of the front and back panels, 17 and 18, and is provided with end portions 20 which project a distance beyond the termination of the front and back panels. Fabrication techniques generally applicable to pliable sheet material of this nature are employed and may incorporate the use of a corded-seam construction 21 to enhance the strength of the unit. While the construction techniques employed in fabricating the club protecting cover, as shown in the drawings, appears to resemble a substantially straight sided construction, it will be recognized that the pliability of the material utilized will permit the cover to readily conform to the specific configuration of the golf bag 11.

As can be best seen in FIG. 3, the front and back panels, 17 and 18, are shaped to provide a relatively longer portion for receiving the woods of a club set, and a relatively shorter length portion for the irons. While only three woods are diagramatically shown in FIG. 3, it will be understood that a set of woods may include four clubs with the cover dimensionally constructed to accomodate a full set. The longitudinal extent of the differences in length of the two sections approximates about one-half or less of the length of the shell-form body as measured from the open end. It will also be noted while the transverse proportions of the different length sections is such that one-third is alloted to the shorter length section which is associated with the irons, this dimension will be determined by the specific area or volume requirements for the irons and woods.

Extending transversely across the exterior surface of the sidewall 19 at the approximate juncture point of the different length portions of the front and back panel sections 17 and 18, is an elongated tubular sleeve 22. This sleeve 22 is also sewn to the sidewall, 19, and receives the resilient cord 15. The resilient cord 15 is of conventional construction embodying a number of separate resilient strands bundled into a unitary structure and merely extends through the tubular sleeve 22 in an otherwise unrestrained manner. As previously indicated, connector hooks 16 are attached to each of the free ends of the resilient cord 15 for engagement with the attachment belts 13 or rings 14 mounted on the golf bag 11. One form of connector hook 16 that has been found particularly adaptable to this structure comprises a structurally rigid rod or wire having a portion **16*a* thereof tightly wound onto the end of the cord in crimped relationship. The remaining portion 16*b*** of the hook projects axially relative to the cord and has an open end loop formed in the terminal end portion.

Disposed within the interior of the shell-form body is an elongated partition wall 23. This partition wall 23 is also formed of the same pliable sheet material as the shell-form body and extends longitudinally thereto as can best been seen in FIG. 3. One end 24 of the partition wall is formed with a seam 24 disposed at the open end of the shell-form body. The other end 25 of the partion wall 23 which projects into the interior of the body, is curved into alignment with the interior surface of the sidewall 19 at the approximate point where the tubular sleeve 22 is attached. This curved end 25 of the partition wall is also sewn securely to the sidewall 19 as are each of the longitudinally extending side edges 23a, which are sewn to the respective front and back panels, 17 and 18. As can be best seen in FIG. 3, it will be noted that the partition wall 23 is disposed with the end seam 24, at approximately the midpoint of the width of the body, and results in the formation of two separated compartments with the one compartment for the irons being of a relatively smaller size.

A layer of cushioning material 26, is also preferably secured to the interior wall of the sidewall 19. The compartment for the irons is also preferably provided with a secondary or interior wall 27 for additional strength. This secondary wall 27 which is also fabricated from a similar pliable sheet material, is sewn at respective ends to the extension 20 of the sidewall 19 and to the interior partition wall 23 as well as to the front and back panels 17 and 18. The layer of cushioning material 26 is interposed between the secondary wall 27 the partition wall 23 and the sidewall 19.

In utilization of club protecting cover, 10, as shown in FIG. 1, the cover will be first positioned over the open top of the golf bag 11 assuming that the clubs are inserted and positioned in the golf bag in the usual manner. The woods will thus project upwardly into the relatively longer compartment while the irons project into the relatively shorter and smaller compartment, as diagrammatically illustrated in FIG. 3. When thus positioned, the edge portions of the front and back panels 17 and 18 will be in engagement with and supported on the interior structural elements (not shown) of the golf bag. Also, the sidewall extensions 20 will project a distance into the interior of the golf bag to enhance the retainability of the cover on the golf bag. At this point connector hooks 16 of the resilient cord 15 are pulled into position for engagement with respective attachment belts 13 on the golf bag. This results in extensioin of the resilient cord and simultaneous application of a compression force on the cover through the resilient forces developed in the cord. This compression effect of the resilient cord is illustrated in FIG. 1, where it will be seen that the cord has now forced the sidewall and adjacent portions of the front and back panels 17 and 18, into a deformed relationship to further emphasize the separation and distinction as between the two compartments formed by the partition wall 23. This completes the installation and mounting of the club protecting cover 10 of this invention onto a golf bag.

Figure 4:
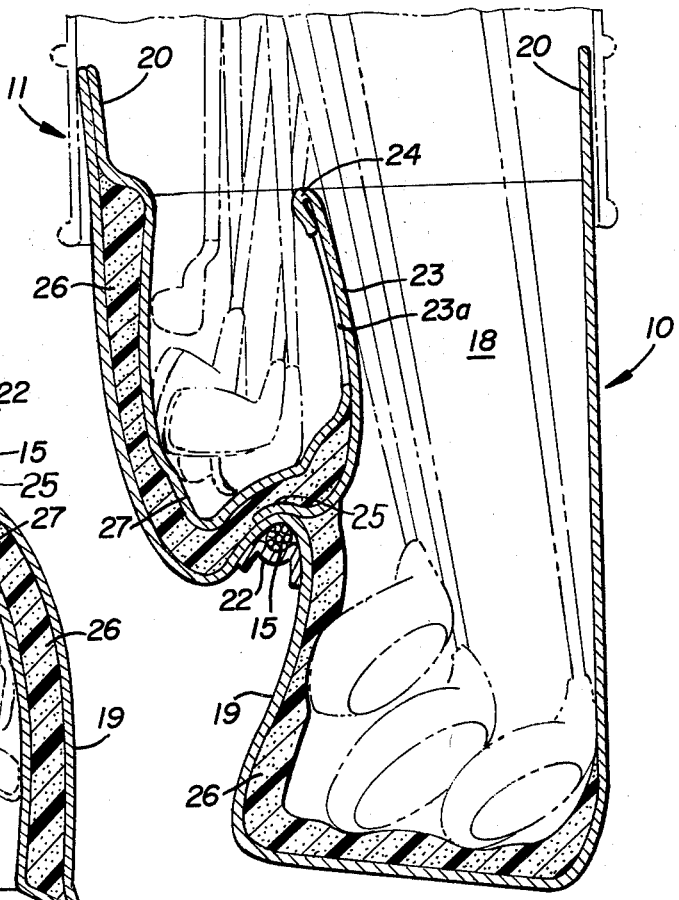
FIG. 4 is a similar sectional view of the club protecting cover installed with a golf bag but with the bag and cover inverted showing the protective functioning of the cover.

The advantageous protective functioning of the club protecting cover 10 is illustrated in FIG. 4. In that figure, the golf bag with clubs and the protective cover are shown in an inverted position such as would be encountered when the bag is inadvertently dropped or should fall from a baggage conveying apparatus. The assembled bag and cover are depicted in a completely inverted position at a point of impact of the cover with the ground. At this instant the woods will be in engagement with the layer of cushioning material 26 which will be deformed at the points of contact in accordance with the momentum forces at the instant of impact. At the instant of impact, the irons, as a consequence of the momentum gained through the proceeding portion of the fall, will result in the irons continuing to descend and forceably project against the interior wall 27 of the respective compartment. This force is substantial due to the weight of the irons and will cause this portion of the cover to deform to a substantial extent. Resisting this deformation is the resilient cord 15 which also maintains the protective cover 10 in association with the golf bag 11. The exact extent of deformation is dependent upon distance through which the golf bag may have fallen as well as the weight of the irons that are enclosed within the bag.

Another important advantageous feature of the construction will be observed in FIG. 4. This feature is the ability of the resilient cord 15 due to its point of attachment on the sidewall 19 to assist in maintaining separation of the two compartments containing the irons and woods. This location of the resilient cord and its attachment results in the irons attempting to deform the associated portions of the cover in independent relationship to the compartment containing the woods. Consequently the resilient cord materially aids in maintaining the separate and partitioned relationship of the two compartments. Without the resilient cord, the momentum of the irons could easily result in propulsion of the irons, although retained in their respective compartment, into engagement with the woods. The consequent disasterous result is the irons cracking or breaking the woods at the juncture of the heads and the shaft.

It will be readily apparent from the foregoing description of the illustrated embodiment of a club protecting cover embodying this invention that a device has been provided which is successively capable of protecting the woods from damage by the irons as is often encountered during baggage handling operations. The combined arrangement of an interior partition wall with a resilient cord produces a particularly effective division of the cover into two separate compartments for the woods and irons.

Having thus described the invention, what is claimed is:

1. A club protecting cover for a golf bag comprising a shell-form body fabricated from pliable sheet material having a tubular wall closed at one end and open at the other with a transverse corss-sectional configuration at the open end to closely interfit with an open top of a golf bag, said body having a peripheral edge formed to cooperatively interengage with the marginal end portion of the open top of a golf bag and a partition wall fabricated from pliable sheet material and disposed interiorly of said body and dividing said body into two axially extending compartments for receiving the head portions of golf clubs with irons and woods disposed in respective ones of said compartments, said partition wall secured along longitudinally extending sides thereof to diametrically opposed sides of the tubular wall of said body and secured at an interiorly disposed end thereof to said body, and resilient securing means interconnecting exteriorly with said body at the juncture thereof with the interiorly disposed end of said partition wall and said resilient securing means provided with attachment means positioned on the same diametrically opposed sides of said body to which said parition wall is secured, said attachment means adapted to cooperatively engage with the golf bag.

2. A club protecting cover according to claim 1 having a layer of resilient cushioning material applied to interior wall surfaces of said body, said resilient cushioning material applied to at least those interior surfaces of the closed end to provide protection for the heads of golf clubs.

3. A club protecting cover according to claim 2 wherein said layer of cushioning material extends a distance along longitudinally extending wall portions of said body and said partition wall.

4. A club protecting cover according to claim 1 wherein said resilient securing means is an elongated cord provided with said attachment means at each end thereof.

5. A club protecting cover according to claim 4 wherein said body includes an elongated tubular sleeve secured thereto exteriorly at the juncture of said partition wall and said body, said resilient cord projecting through said sleeve.

6. A club protecting cover according to claim 1 wherein said compartment for receiving the head portions of the irons is provided with a secondary wall fabricated from pliable sheet material, said secondary wall disposed interiorly of said body wall and said partition wall and secured to said body and partition walls, and a layer of resilient cushioning material interposed between said body wall, partition wall and secondary wall.

7. A club protecting cover according to claim 1 wherein said shell-form body includes spaced apart front and back panels and a peripheral sidewall interconnected therewith at forming a unitary structure, said partition wall extending between said front and back panels and secured thereto.

8. A club protecting cover according to claim 7 having extensions formed with said sidewall at each end thereof and projecting a distance therefrom for relatively greater insertion into a golf bag.

9. A club protecting cover according to claim 1 wherein said compartment for receiving the irons is of relatively shorter axial length than said compartment for receiving the woods.

* * * * *